US006518581B1

(12) United States Patent
Dheandhanoo et al.

(10) Patent No.: US 6,518,581 B1
(45) Date of Patent: Feb. 11, 2003

(54) APPARATUS FOR CONTROL OF GAS FLOW INTO A MASS SPECTROMETER USING A SERIES OF SMALL ORIFICES

(75) Inventors: Seksan Dheandhanoo, Quakertown, PA (US); Ralph J. Ciotti, Schnecksville, PA (US); Suhas Narayan Ketkar, Allentown, PA (US); Richard Vincent Pearce, Kempton, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 09/539,605

(22) Filed: Mar. 31, 2000

(51) Int. Cl.[7] ..... H01J 39/34; H01J 39/00
(52) U.S. Cl. ..... 250/430; 250/281; 250/282
(58) Field of Search ..... 250/288, 306, 250/281, 282, 287, 430, 428

(56) References Cited

U.S. PATENT DOCUMENTS 3,673,405 A * 6/1972 Moorman et al. ..... 250/288
3,933,047 A 1/1976 Fowler ..... 73/421.5
4,542,293 A * 9/1985 Fenn et al. ..... 250/288
5,037,611 A * 8/1991 Ledford, Jr. ..... 422/63
5,859,433 A 1/1999 Franzen ..... 250/292

FOREIGN PATENT DOCUMENTS

WO 9736177 10/1997 ..... G01N/33/00

* cited by examiner

*Primary Examiner*—John R. Lee
*Assistant Examiner*—David A. Vanore
(74) *Attorney, Agent, or Firm*—Geoffrey L. Chase

(57) ABSTRACT

A gas sampling and inlet device for a mass spectrometer has a hollow housing sleeve with an open inside region and a hollow inner sleeve with an open inside region, with the inner sleeve coaxial to the housing sleeve. One end of the housing sleeve and one end of the inner sleeve are connected with a single first end cap. The second end of the housing sleeve has a second end cap, but the second end of the inner sleeve is open such that the inside of the inner sleeve is open to the inside of the housing sleeve. The first end cap has a small diameter orifice adapted to receive a gaseous fluid. The second end cap is connected to a mass spectrometer. The second end cap has an orifice adapted to receive a gaseous fluid into the mass spectrometer that is substantially smaller in diameter than the orifice in the first end cap. The housing sleeve has a vacuum pump port to allow a vacuum to be created in the interior of the inlet device.

27 Claims, 14 Drawing Sheets

APPARATUS FOR CONTROL OF GAS FLOW INTO A MASS SPECTROMETER USING A SERIES OF SMALL ORIFICES

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to a system for introducing a gaseous sample and/or calibration streams into an analytical instrument such as a mass spectrometer. More particularly, the present invention is concerned with an improved method and means for the collection and introduction of gas samples into mass spectrometers.

Mass spectrometry technique has been applied extensively to numerous applications, including in situ monitoring and effluent analysis of microelectronic manufacturing tools. In a typical mass spectrometer, a beam of electrons is used to ionize gas molecules inside the mass spectrometer vacuum chamber. These ions are directed, via electric and magnetic fields, to a detector which produces a mass spectrum. Mass spectrometers typically have a vacuum chamber or spectrometer tube into which the gas to be analyzed enters. This vacuum chamber is often operated at a pressure less than $10^{-5}$ torr. Accordingly, in operations of a generalized mass spectrometer gas analyzer, the sample gas under test is admitted, under vacuum, into the ion source of the mass spectrometer wherein the sample gas is ionized such as by electron bombardment thereof. The resulting ion beam is then projected downstream through an analyzer which may comprise a controllable magnetic field oriented perpendicularly to the axis of the ion beam. The magnetic field thus acts to "focus" or cause each specie of ion or ion fragment forming part of the ion beam to describe a definite characteristic trajectory, the radius of trajectory being dependent upon the mass-to-charge ratio of the particular ion or ion fragment specie being acted upon by the magnetic field. Stationed at the end of the ion beam path is an ion collector which, in association with appropriate electronics, is responsive to the impact of those ions and ion fragments not segregated out of the beam by the analyzer. By scanning the analyzer over a range or spectrum of magnetic field strengths, the ion collector is made to quantitatively respond to different ion mass species in the sample gas ion beam.

Variations on the above-outlined theme of mass spectrometer gas analyzer operations are also known. For instance, time of flight mass spectrometers depend upon accelerator components which accelerate the ions and ion fragments formed in the ion source. Here, the ion beam is subjected to controlled acceleration forces generated by a dynamic electric field. For a gas sample containing various charged ion species, each mass-to-charge specie of the sample has associated with it a unique flight time in the dynamic electric field, which time is measured. Accordingly, the various particles are resolved according to their mass-to-charge ratios by recording differences in their flight times in the dynamic electric field.

Other common types of mass spectrometers available include quadrupole, Fourier transform, ion-trap, and magnetic-sector. For example, in operation, the quadrupole mass spectrometer consists of an ion source, ion optics that accelerate and focus ions through an aperture in a quadrupole mass filter, an exit aperture, an ion detector and a high vacuum system. The quadrupole mass filter has four parallel metal rods. Applied voltages affect the trajectory of ions traveling down a center point between the four rods. At defined DC and AC voltages, only ions of a certain mass to charge ratio pass through the filter while all other ions are deflected out of the center. A mass spectrum is obtained by monitoring the ions as voltages are varied.

Whatever the precise mode of operations employed in mass spectrometer gas analyzers, however, all are characterized by their operations under relatively extremely low pressure, by their application of an ionizing charge to the sample gas molecules undergoing analysis and by their selective measurement of parameters which are directly relatable to mass-to-charge relationships of the ionized species of the sample gas.

An important issue relating to the use of a mass spectrometer is sample introduction. Several sample introduction techniques and sampling inlets are currently used for in situ monitoring and effluent analysis. The primary function of these inlets is to limit the amount of gas entering the mass spectrometer which, as stated above, is typically operated at a pressure below $10^{-5}$ torr.

Commonly used inlets are made of capillary tubing, small orifices, and leak valves. Using a capillary tube is an inexpensive technique and can be adjusted to a wide range of pressures by varying the dimensions, particularly the length of the tube. The conductance of the gas sample is inversely proportional to the length of the tube. To keep the sample flow rate constant, the tube can be made longer as the pressure of the sample increases. However, the use of capillary tubing often causes a delay in response time and a mass discrimination effect, which can occur when gases of vast differences in molecular mass travel through a long tube.

Leak valves allow the user to easily adjust the flow rate of gas as the sampling pressure changes. A drawback of leak valves is the elastomer material that is often used in the construction. These elastomer materials can absorb and desorb some chemicals, which may result in a memory effect. Also, leak valves often have long sample clearing time due to their internal dead volume.

The mass spectometer with its ion source is located in the vacuum chamber. The ions from the ion source in the mass spectrometer are admitted together with large quantities of ambient gas. For this purpose, small openings with diameters of approximately 30 to 300 micrometers, or 10 to 20 centimeter long capillaries with internal diameters of approximately 500 micrometers are used. The excess gas, particularly the ambient gas, usually must be removed by means of differentially operating pump stages. In the case of commercially available mass spectrometers, there is usually one or two turbomolecular pumps and one or two mechanical pumps (sometimes called backing or roughing pumps) with a corresponding number of pump-connected chambers in front of the main chamber of the mass spectrometer to create the required vacuum.

The capillary system can cause a few problems. First, the clearing time of the capillary is not fast, particularly for a long one. For slow processes, this is not a true disadvantage. Second, the capillary is easily clogged. If a small particle gets into the capillary, it will get clogged. The particle can move along the tube, which can make the capillary impossible to unclog. It is not easy to change the capillary in most commercially available instruments.

To circumvent the problems related to the capillary tube and the leak valve, a small orifice to limit the flow of gas samples into the mass spectrometer may be used. The use of one orifice as a sample inlet works well; however, the flow rate of gas through one small orifice is relatively high due to a large pressure difference. Therefore, it is necessary for the mass spectrometer chamber to have sufficient pumping capacity for handling a high gas load. The requirement for a large pumping capacity leads to the use of an expensive, differentially pumped system.

As is already apparent from this description, the differentially operating pump stages used up to now are disadvantageous. They make it more difficult to transfer the sample gases to the mass spectrometer, make operation of the mass spectrometer complex and require the use of several costly, large high-vacuum pumps.

The cost of a differentially pumped system is considered an inhibiting factor for using the mass spectrometer as an analytical instrument. Furthermore, most differentially pumped system are custom-made and are difficult to find.

Several other patents in the prior art provide inlets for mass spectrometers. However, it is believed that none provides the unique combination of features of the present invention. U.S. Pat. No. 3,933,047 provides a mass spectrometer system with a gas sampling inlet having an inlet orifice and an outlet orifice. However, here, unlike the present invention, the port which establishes communication with the mass spectrometer is located between the two orifices. Additionally, the '047 sampling inlet must operate under critical flow conditions which is defined as that gas flow rate through he orifices which cannot be further increased simply by further decreasing the pressure on the low pressure sides of the orifices. Finally, the orifice size and the difference in size between the orifices is not deemed critical.

PCT published application PCT/CH97/00122 discloses an arrangement for connecting a low pressure inlet of a gas analyzer. This application discloses a gas inlet that has an adjustable escape valve.

U.S. Pat. No. 5,859,433 provides an ion trap mass spectrometer that uses only a single high-vacuum pump without the need for differential pumping by means of a series of small inlet openings.

It is principally desired to provide a novel inlet for a mass spectrometer for the introduction of sample gases.

It is further desired to provide an inlet for a mass spectrometer that is capable of sampling gases at atmospheric pressure without requiring a differentially pumped system.

It is further desired to provide an inlet that is capable of sampling gases at atmospheric pressure without requiring a differentially pumped system where the sample inlet possesses the desired characteristics for effluent monitoring.

It is further desired to provide an inlet for a mass spectrometer that is capable of introducing compositionally representative samples into the mass spectrometer.

It is still further desired to provide an inlet for a mass spectrometer that provides a rapid and accurate method for continuously sampling gases at atmospheric pressures.

It is also desired to provide an inlet for a mass spectrometer that is capable of withstanding a corrosive environment.

It is still further desired to provide an inlet for a mass spectrometer that is functional over a wide range of pressures.

It is still further desired to provide an inlet for a mass spectrometer that has a short response time.

It is still further desired to provide an inlet for a mass spectrometer that does not easily clog.

It is further desired to provide an inlet for a mass spectrometer that has a minimal amount of dead volume.

Finally, it is desired to provide an inlet for a mass spectrometer that has negligible memory effects.

BRIEF SUMMARY OF THE INVENTION

The present invention is a gas sampling and inlet device for a mass spectrometer. The inlet device has two orifices of different diameters used to limit the flow of gas samples into the mass spectrometer. The two orifices form a pressure reduction region regulated by a vacuum pump and needle valve. Importantly, the flow of gases through the inlet orifices is viscous flow. The sample inlet is applicable to sampling gases at various pressures, ranging from atmospheric to a few torr. The inlet allows direct sample introduction into the ion source of a mass spectrometer.

In a first embodiment, the gas sampling and inlet device for a mass spectrometer includes a hollow housing sleeve having a first end, a hollow body, and a second end, the first end has a first end cap and the second end has a second end cap. The first end cap has a small diameter orifice adapted to receive a gaseous fluid and the second end cap is sealed to a mass spectrometer. The second end cap has an orifice adapted to receive a gaseous fluid into the mass spectrometer that is substantially smaller in diameter than the orifice in the first end cap. The housing sleeve has a vacuum pump port to allow a vacuum to be created in the interior of the inlet device. The inlet device is preferably operated in the viscous flow regime. Additionally, the inlet is preferably made of all metal components. It is preferable that pressure inside the inlet is approximately 10 to 100 torr.

Preferably, the gas sampling and inlet device for a mass spectrometer includes the above, and additionally includes a hollow inner sleeve having an open inside region, coaxial to the housing sleeve. The inner sleeve has an inlet end, a hollow body, and an outlet end. The first end of the housing sleeve and the inlet end of the inner sleeve are coaxial and sealed to the first end cap. The outlet end of the inner sleeve is open such that the open inside region of the inner sleeve is open to an open inside region of the housing sleeve. Preferably, a vacuum source tube is connected to the housing sleeve at a location between the inlet end and the outlet end of the inner sleeve. Additionally, it is preferable that the inner sleeve is ⅛ inch to ¼ inch shorter than the housing sleeve.

In the above embodiments, it is preferable that the housing sleeve and inner sleeve (if applicable) are cylindrical in shape.

DETAILED DESCRIPTION OF THE INVENTION

Figure 1:
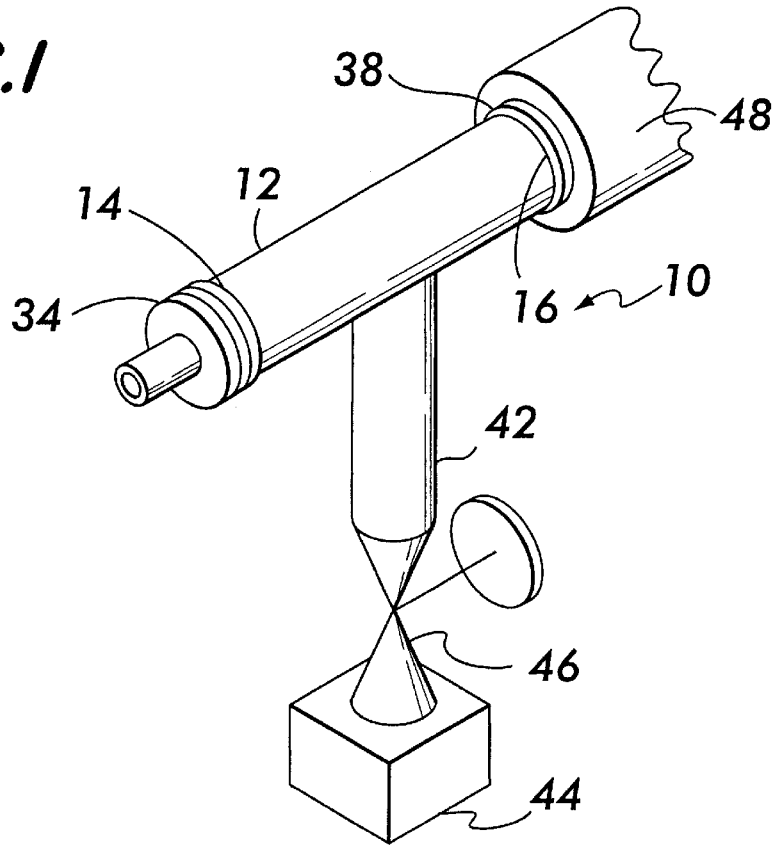
FIG. 1 is a perspective view of a mass spectrometer inlet in accordance with a first embodiment of the present invention.
Figure 3:
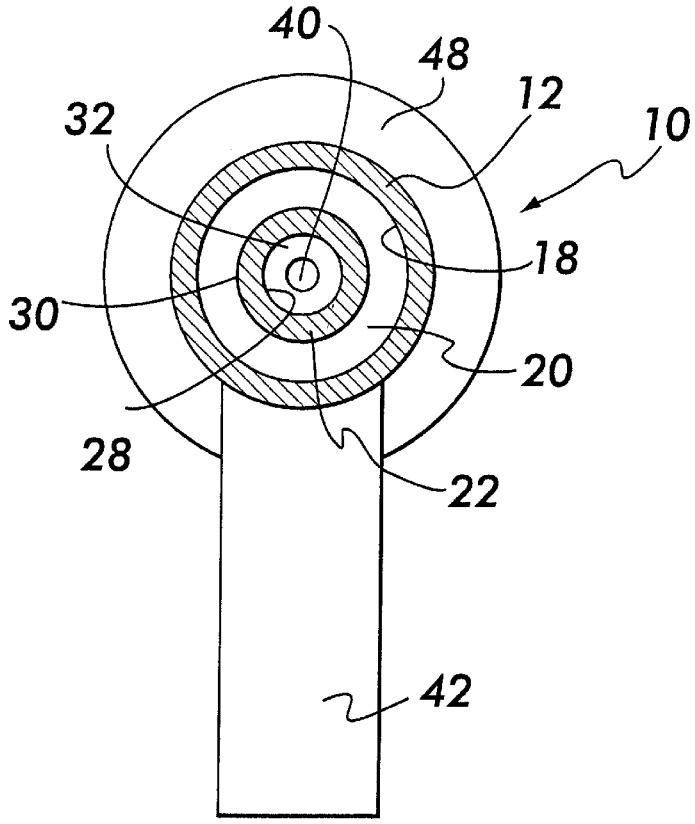
FIG. 3 is a cross sectional, front elevation view of the mass spectrometer of FIG. 1 taken substantially along line 3—3 of FIG. 2.

Referring now to the drawings, there is shown in FIGS. 1–4, a mass spectrometer inlet 10 in accordance with one preferred embodiment of the present invention. A mass spectrometer inlet will be described herein, the dimensions of which were designed to operate optimally with a quadrupole mass spectrometer using approximately a 200 liter per minute vacuum pump. However, using the basic teachings of this specification, one skilled in the art could optimize the dimensions of the various design elements for substantially any type of suitable mass spectrometer and vacuum pump size. The spectrometer inlet of the present invention preferably comprises a housing sleeve 12, an inner sleeve 22, a first end cap 34, a second end cap 38, and a vacuum source tube 42. The housing sleeve 12 and inner sleeve 22 are preferably manufactured from cylindrical stainless steel tubing. For the present example, a ¼ inch outside diameter would be appropriate for the housing sleeve 12 and ⅛ inch outside diameter would be appropriate for the inner sleeve 22.

The housing sleeve 12 preferably has a first end 14 sealingly connected to the first end cap 34. Located inside and coaxial to the first end cap 34 is inner sleeve 22 which has an inlet end 24 and an outlet end 26. The inlet end 24 of the inner sleeve 22 is also sealingly connected to the end cap 34. End cap 34 may be a standard ¼ inch VCR™-typefitting or a Conflat®-type fitting. Joining of metal can otherwise be performed by welding or other processes as are known in the art.

The housing sleeve 12 is hollow such that there is an open inside region 20 which is the volume inside the housing sleeve 12 created by the inside housing sleeve surface 18 and between the two end caps 34, 38 which will be described in more detail below. Additionally, the inner sleeve 22 is hollow such that there is an open inside region 32 which is the volume inside the inner sleeve 22 created by the inside inner sleeve surface 30.

End cap 34 has a small diameter orifice 36 located at the center point of the cap 34 such that the orifice 34 is substantially along the axial center line of both the housing sleeve 12 and inner sleeve 22. For the present example, an orifice diameter of approximately 0.004 to 0.006 inches is preferable.

Figure 2:
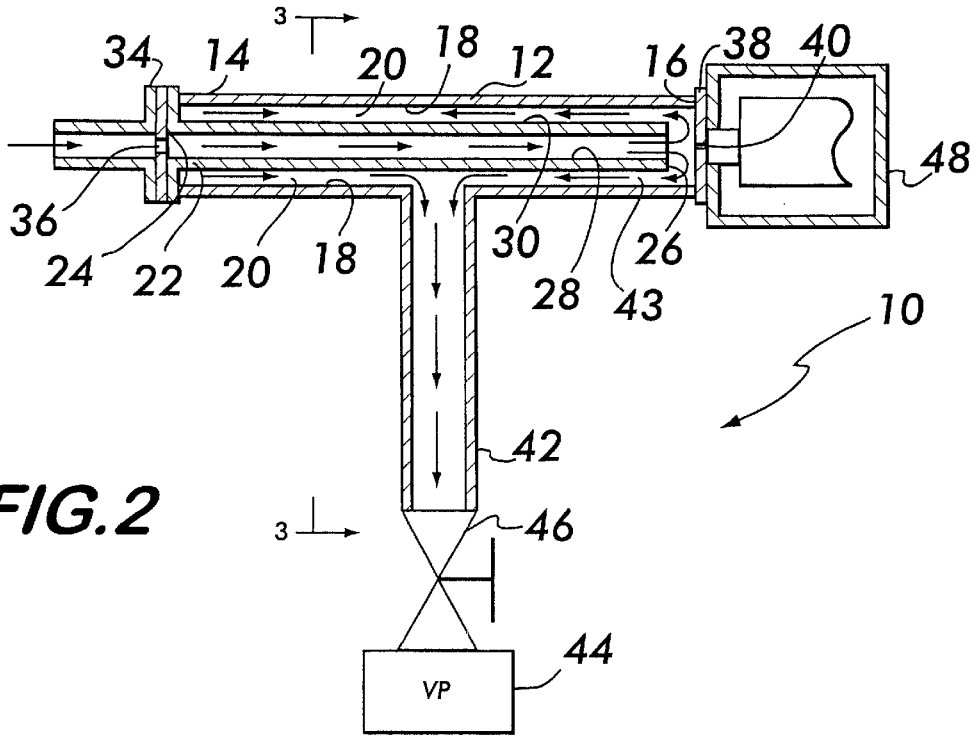
FIG. 2 is a cross sectional, cutaway, side elevation view of the mass spectrometer inlet of FIG. 1.

The second end 16 of the housing sleeve 12 is sealingly connected to the second end cap 38. The second end cap 38 also has a small diameter orifice 40 which is located at a point substantially along the center line of both the housing sleeve 12 and inner sleeve 22. The orifice size for the small diameter orifice 40 is preferably approximately 0.0008 inches to 0.0015 inches, or approximately 10 to 40 percent as large as the small diameter orifice 36 in end cap 34. However, unlike as in the first end cap 34, the inner sleeve 22 is not sealingly connected to the second end cap 38. The inlet end 24 of the inner sleeve 22 is sealingly connected and cantilevered out from the first end cap 34 coaxial to the housing sleeve such that the outlet end 26 of the inner sleeve 22 is in close proximity to the second end cap 38, but not touching it. For the present example, a distance of approximately ⅛ to ¼ inch between the outlet end 26 of the inner sleeve 22 and the second end cap 38 would be appropriate. As can be seen in FIG. 2, when manufactured in this manner, a gas may flow into the orifice 36 in the first end cap 34, through the open inside region 32 of the inner sleeve, out the outlet end 26 of the inner sleeve 22 and then out through both the orifice 40 in the second end cap 38 or around the outlet end 26 of the inner sleeve 22 and into a pressure reduction region 43 of the inlet 10 which is the volume between the outside inner sleeve surface 32 and the inside housing sleeve surface 18.

To work optimally, as indicated above, the size of the small diameter orifice 36 in the first end cap 34 must be significantly larger than the small diameter orifice 40 in the second end cap 38. However, orifice size may vary depending upon the vacuum pump size(s) selected to operate with the mass spectrometer and inlet.

The pressure is reduced in the pressure reduction region 43 by a vacuum source 44 connected to vacuum source tube 42. Vacuum source tube 42 is sealingly connected to the housing sleeve 12, at an axial point between the first end 14 and second end 16 of the housing sleeve adjacent the inner sleeve 22. Preferably, the vacuum source tube 42 should not be located at an axial point on the housing sleeve 12 that is adjacent the gap between the outlet end 26 of the inner sleeve 22 and the second end cap 38.

The preferred embodiment is as described above. However, the invention will operate without the inner sleeve 22. This embodiment creates dead volume which would increase the response time significantly.

The present invention reduces opportunities for the inlet to clog as compared to other mass spectrometer inlets, particularly capillary tube type inlets. If a small particle gets into the capillary, the tube will clog. Clearing the clog can be difficult or impossible. Further, it is difficult to change the capillary in most instruments. The orifices 36, 40 of the present invention may clog, however, the particle can usually easily push through the orifice due to the pressure differential. Therefore, orifice 36 or 40 often may unclog itself.

The inlet 10 is operated in the viscous flow regime; thus, it can maintain a steady flow of gas into the mass spectrometer. The sample pressure is at atmospheric pressure (760 torr). Pressure inside the ion source is preferably approximately $10^{-3}$ to $10^{-4}$ torr and pressure inside the chamber is preferably approximately $10^{-5}$ to $10^{-6}$ torr. Pressure inside the pressure reduction region 43 is preferably maintained at between 10 and 100 torr and preferably approximately 60 torr to ensure that the gas flow is viscous. The viscous flow is determined by the Knudsen number, Kn. The gas flow is viscous when Kn is less than 0.01. In this case, the air sample flows through a 0.125 inch OD tube and the pressure inside the pressure reduction region is preferably approximately 60 torr. The Kn is approximately 0.001, thus, the flow of gas is viscous. As described above, the inlet is made of all metal components that can be heated to a desired temperature and therefore can be used with corrosive gases.

The operating pressure in the viscous flow region is higher than the pressure in the molecular flow region. In the viscous region, the flow of gas through an orifice is controlled by the pressure difference between the two sides of the orifice. Therefore, substantially all types of molecules will be forced to go through the orifice by the pressure difference. Furthermore, an extra pump to evacuate the pressure reduction region is not needed. Since the operating pressure in the viscous region is high enough, it needs only a relatively small pumping capacity. Therefore, a single mechanical pump is typically sufficient to evacuate the pressure reduction region as well as backing the turbomolecular pump for the mass spectrometer vacuum chamber.

Figure 5:
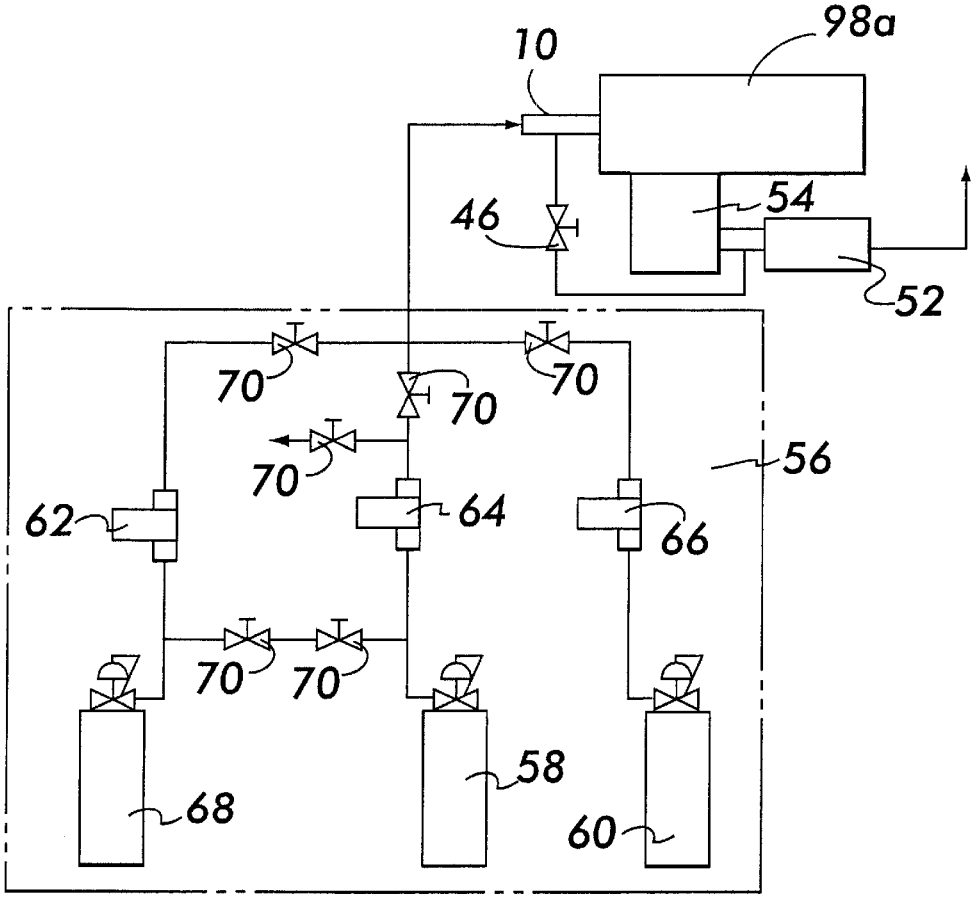
FIG. 5 is a schematic diagram of an experimental setup of a mass spectrometer using the mass spectrometer inlet of FIG. 1.
Figure 4:
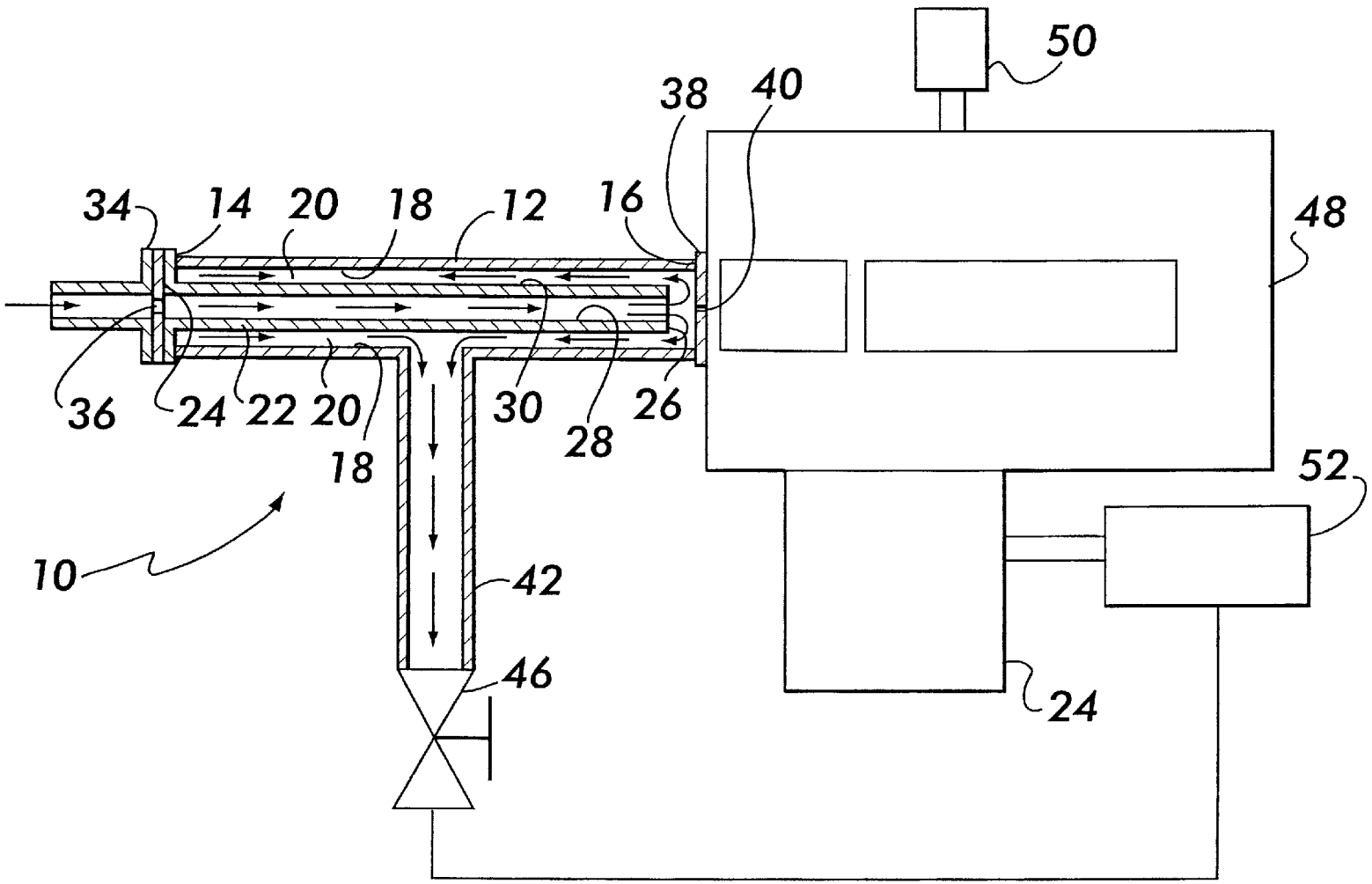
FIG. 4 is a side view of a mass spectrometer system having the mass spectrometer inlet of FIG. 1.

An experimental system was set up to determine the effectiveness of the new design. The system was set up as can be seen in FIGS. 4 and 5. A mass spectrometer system was assembled that can be used to analyze gas samples at atmospheric pressure. The mass spectrometer system consisted of two major components: a quadrupole mass spectrometer 48*a* and the inlet 10 of the present invention (see FIG. 5). Unlike commercially available inlets, as described above, the inlet 10 uses two small orifices to form a pressure reduction region.

To enhance the performance of the quadrupole mass spectrometer 48*a,* it was housed in a temperature-controlled vacuum chamber equipped with appropriate pumps. The temperature-controlled chamber improves the stability of the mass spectrometer significantly and reduces memory effect caused by surface adsorption and desorption.

The mass spectrometer system was tested in the laboratory and in a field environment. The detection limit of the mass spectrometer was determined to be less than 3 ppm and has linear response at both high and low concentrations. The mass spectrometer system provides a fast response to changes in the constituents of gas samples without noticeable memory effects. The field data indicates that the mass spectrometer system is applicable to monitor effluent gases from semiconductor tools.

The inlet 10 was integrated to the quadrupole mass spectrometer 48*a* as shown in FIG. 5. The pressure reduction region 43 of the inlet 10 was connected by the vacuum source tube 42 to the vacuum source 44, a diaphragm pump 52. The diaphragm pump 52 served as the backing pump for the turbomolecular pump 54 as well as the sampling pump for the pressure reduction region 43. The pressure inside the pressure reduction region is controlled by a leak valve 46 (see also FIGS. 1 and 2). The pressure inside the pressure reduction region 43 was maintained at approximately 60 torr and the pressure inside the vacuum chamber was maintained at about $8\times10^{-6}$ torr.

In the experimental system, of interest were the detection limit, response time, and stability of the instrument, which are important characteristics for effluent monitoring. Furthermore, it is important that the system be able to withstand high concentrations of corrosive gases. Several standard gases, including corrosive gases, were used to test the performance of the mass spectrometer system including the inlet 10 of the present invention. The standard gases were generated using a dilution system 56 as shown in FIG. 5. The dilution system 56 consists of a series of mass flow controllers 58, 60, 62, 64, 66, 68 and stainless steel valves 70. The standard gases were produced by blending known amounts of diluent gas ($N_2$) with calibration gas. The mass flow controllers were calibrated with a bubble flow meter and the calibration gases were certified by standard analytical techniques. Therefore, the blending technique should provide standard gases with high accuracy.

Figure 6:
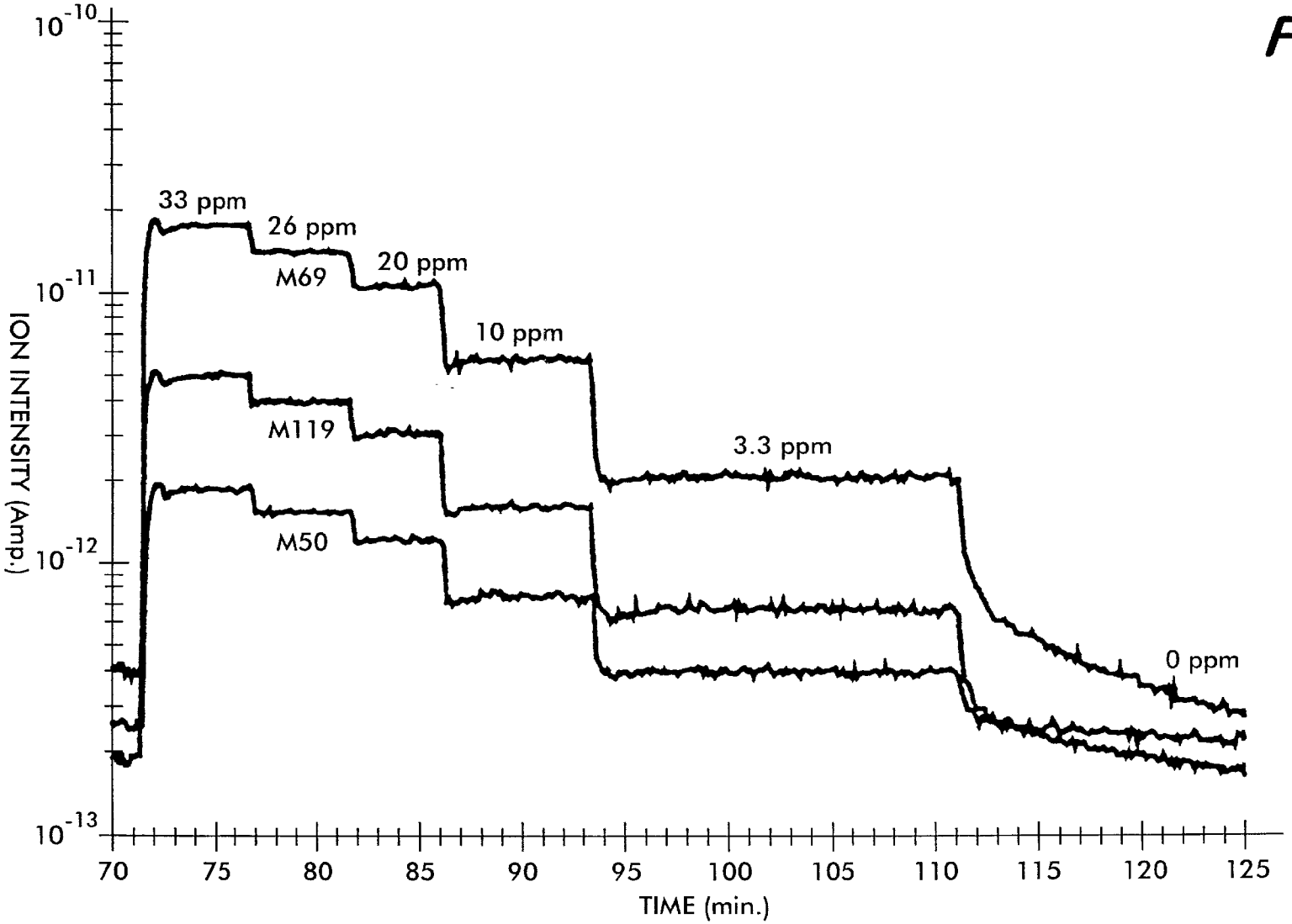
FIG. 6 is a graphical illustration of an example of the response of the mass spectrometer system in accordance with the present invention to variation of $C_2F_6$ concentration.
Figure 7:
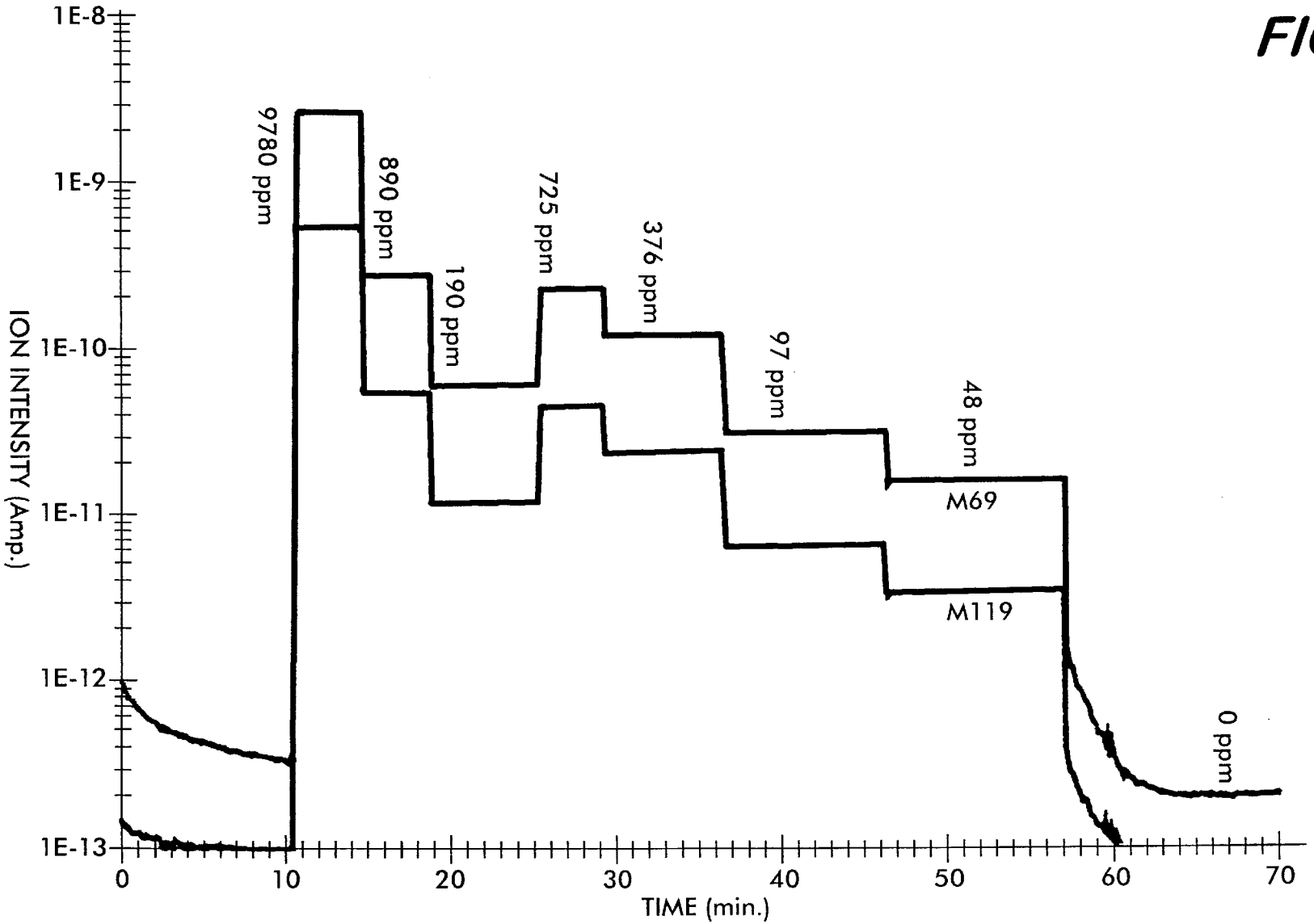
FIG. 7 is a graphical illustration of an example of the response of the mass spectrometer system of the present invention to high $C_2F_6$ concentration.
Figure 8:
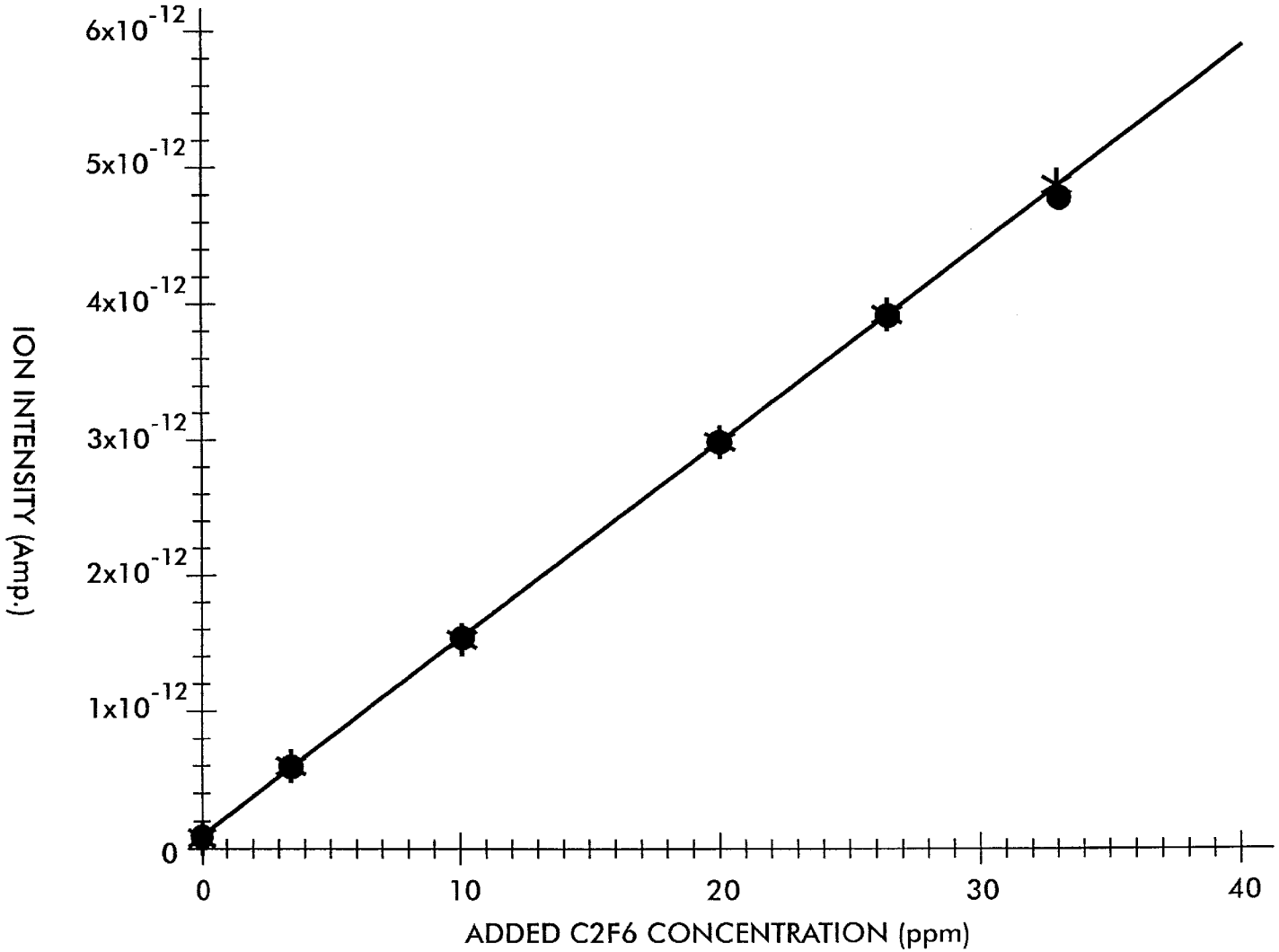
FIG. 8 is a graphical illustration of an example of the response of the mass spectrometer system of the present invention of ion intensity (mass 119) as a function of added $C_2F_6$ at low concentrations.
Figure 9:
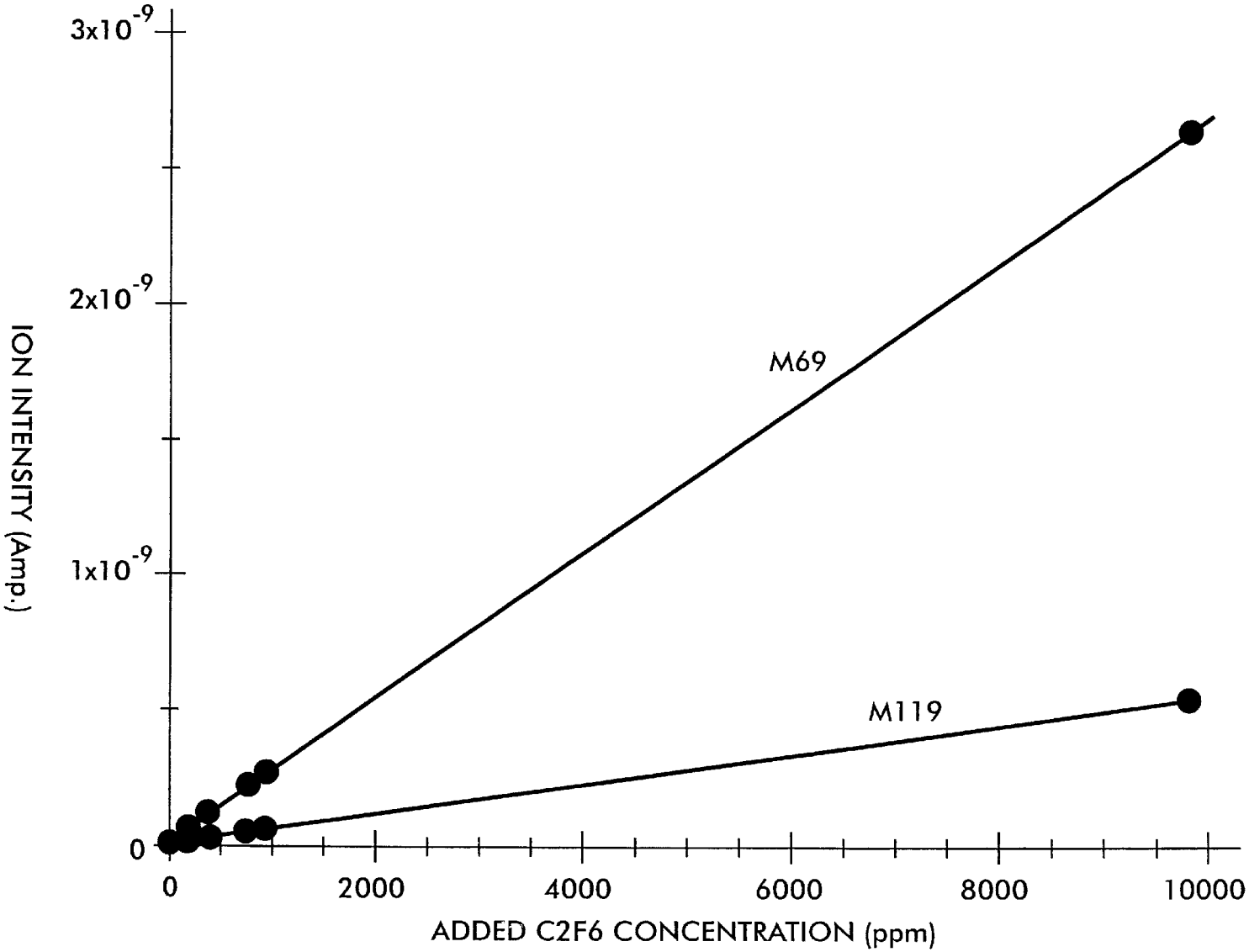
FIG. 9 is a graphical illustration of an example of the response of the mass spectrometer system of the present invention of ion intensities as a function of added $C_2F_6$ at high concentrations.

The detection limit was determined by challenging the experimental mass spectrometer system with standard gases containing various concentrations of selected chemicals. Four chemicals were used in the experiments: $C_2F_6$, $F_2$, $Cl_2$ and $OF_2$. An ion detector that was used was an electron multiplier operating at 1200 volts. The response of the mass spectrometer to $C_2F_6$ is shown in FIG. 6 which is the response of the mass spectrometer system to variation of $C_2F_6$ and FIG. 7 which is the response of the mass spectrometer system to high $C_2F_6$ concentration. Ions of mass 50, 69, and 119 amu were designated as $CF_2^+$, $CF_3^+$, and $C_2F_5^+$, respectively. FIG. 8, which indicates ion intensity (mass 119) as a function of added $C_2F_6$ at low concentrations, and FIG. 9, which indicates ion intensities as a function of added $C_2F_6$ at high concentrations, indicate that the experimental system responds linearly to changes in $C_2F_6$ at both low and high concentrations.

Figure 10:
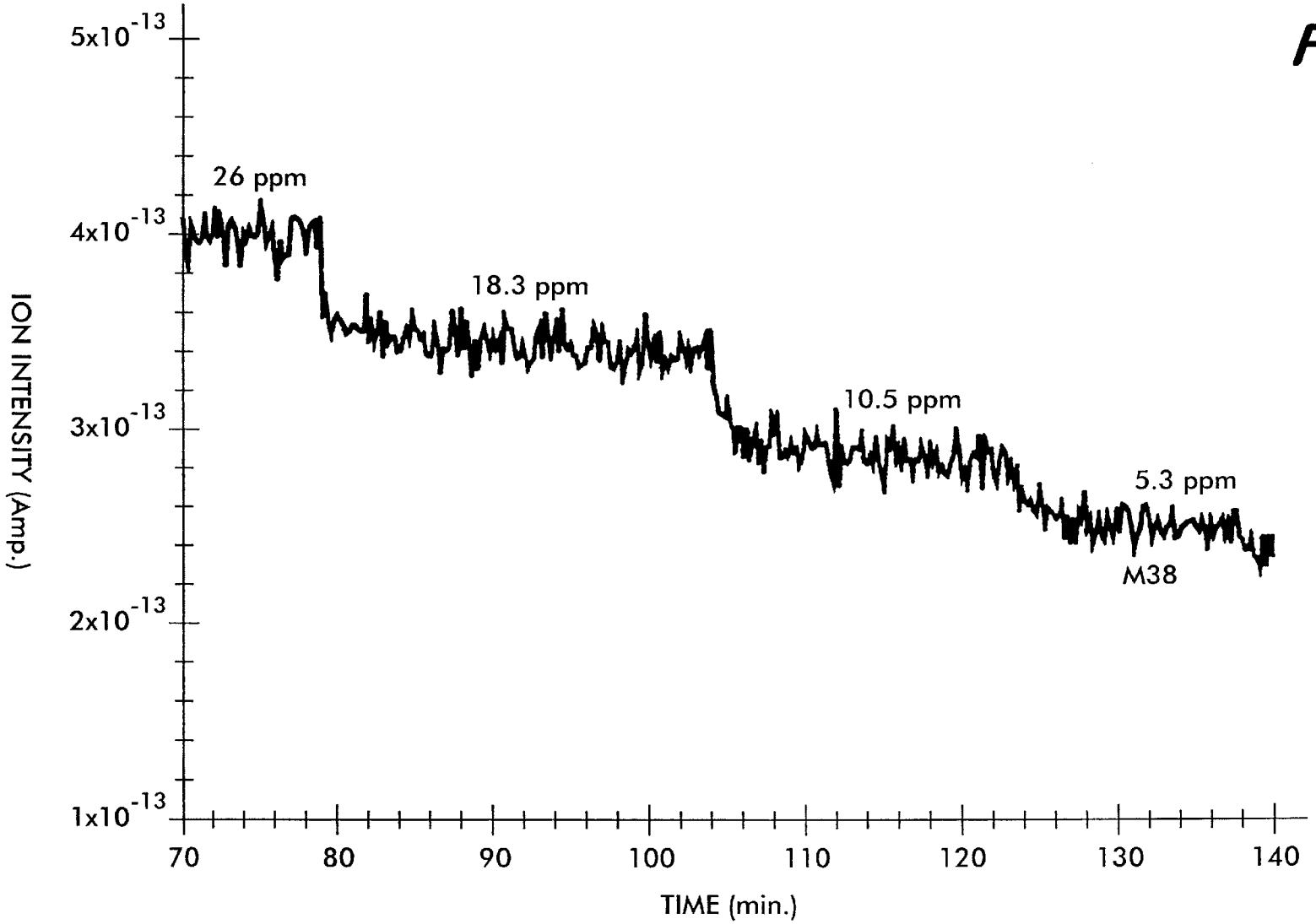
FIG. 10 is a graphical illustration of an example of the response of the mass spectrometer system of the present invention to changes in $F_2$ concentration.
Figure 11:
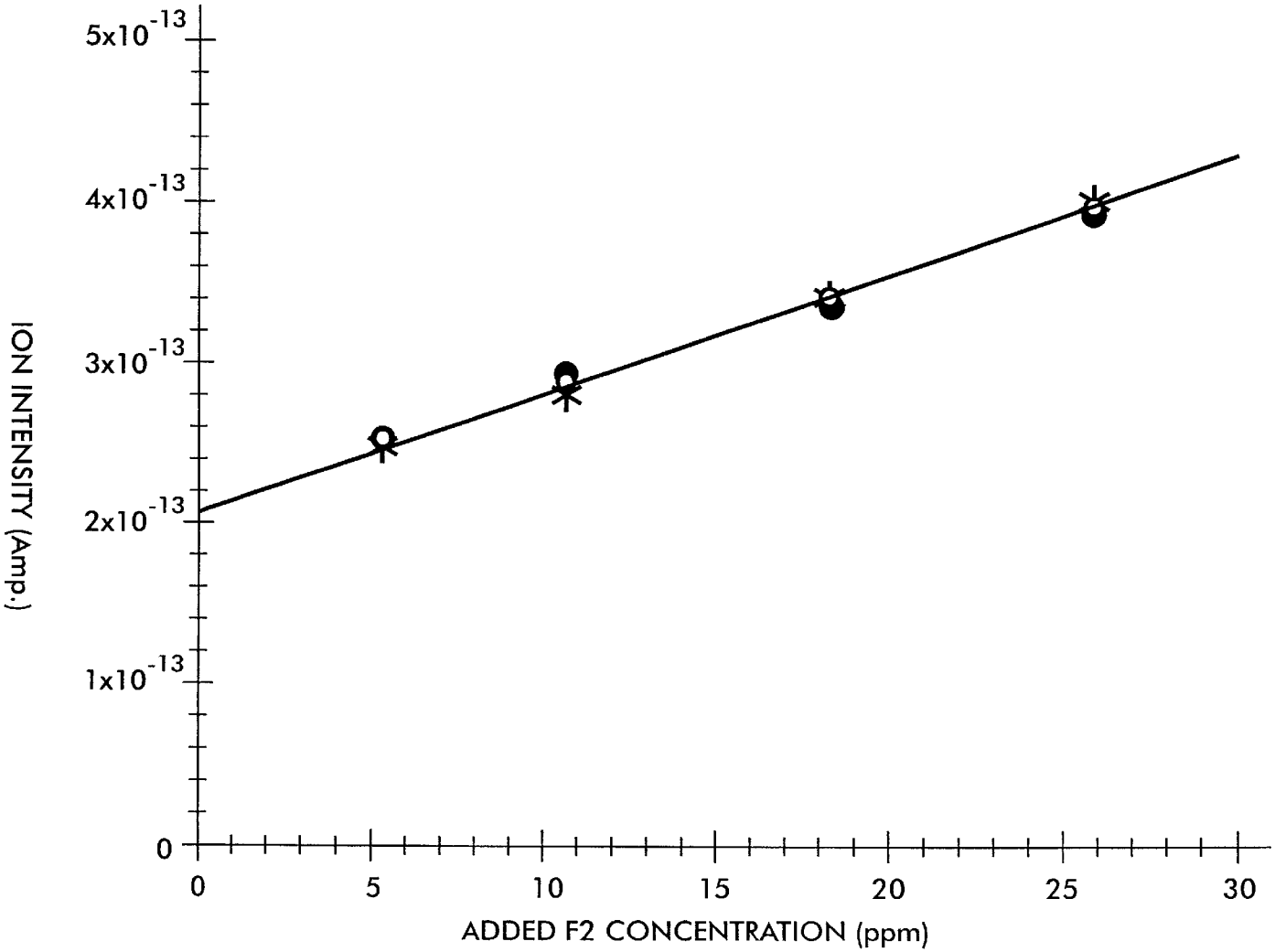
FIG. 11 is a graphical illustration of an example of the response of the mass spectrometer system of the present invention of ion intensity of mass 38 as a function of added $F_2$ at low concentrations.
Figure 12:
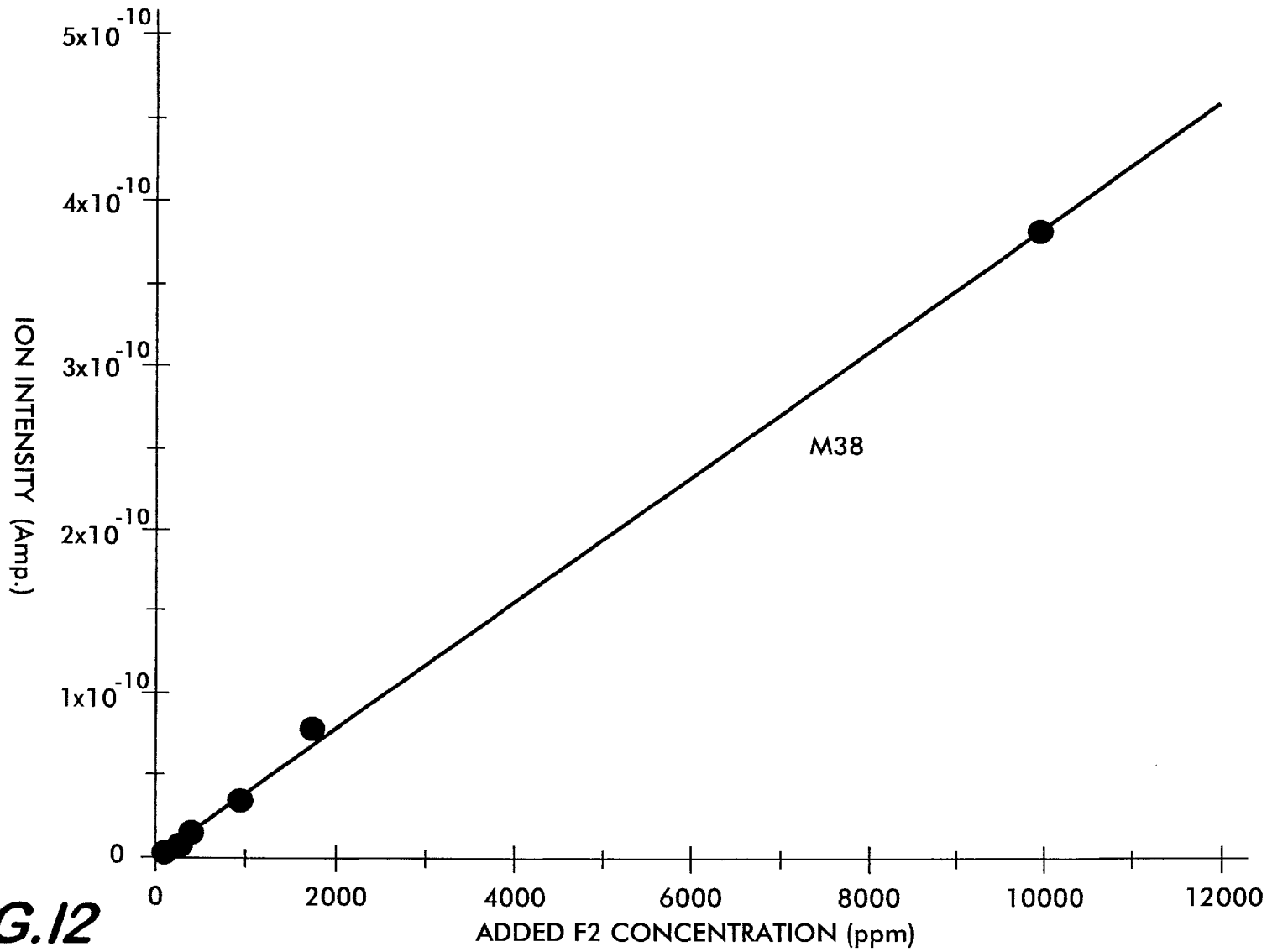
FIG. 12 is a graphical illustration of an example of the response of the mass spectrometer system of the present invention of ion intensity of mass 38 as a function of $F_2$ concentration (high concentration).
Figure 13:
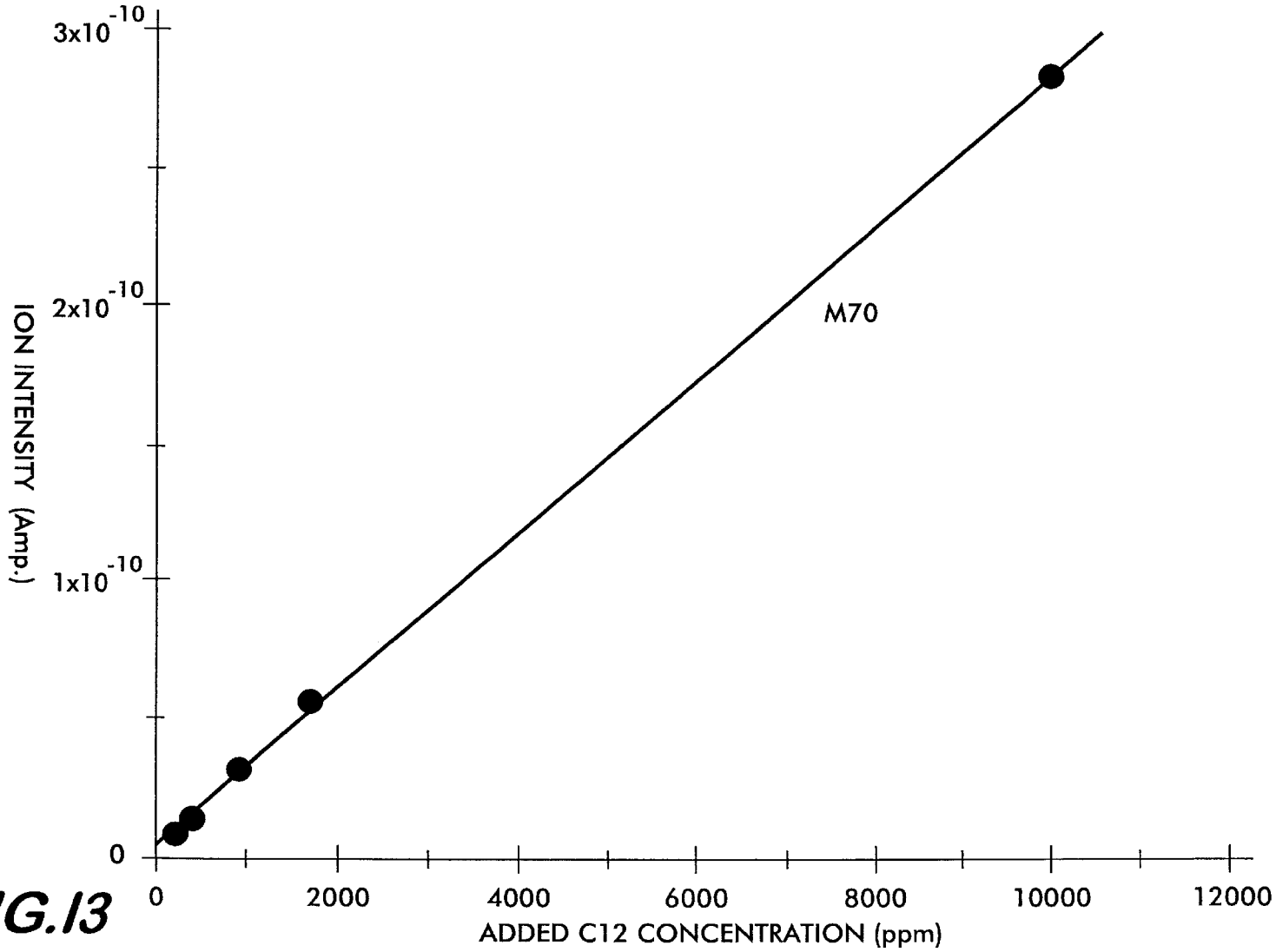
FIG. 13 is a graphical illustration of an example of the response of the mass spectrometer system of the present invention of ion intensity of mass 70 as a function of $Cl_2$ concentration.
Figure 14:
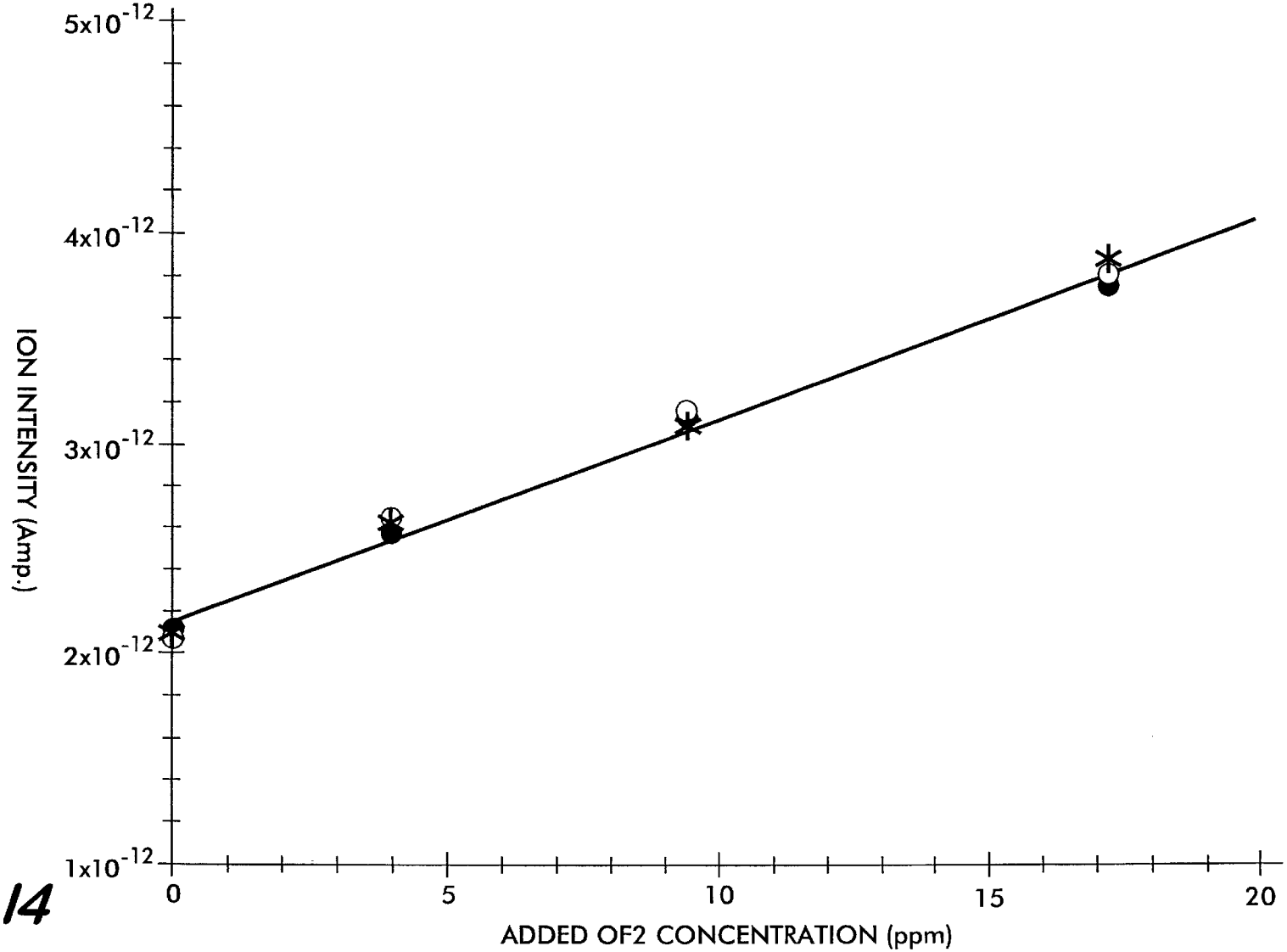
FIG. 14 is a graphical illustration of an example of the response of the mass spectrometer system of the present invention to various amounts of $OF_2$ in $F_2$.

FIG. 10 indicates the response of the experimental mass spectrometer system to changes in $F_2$ concentration. FIG. 11 indicates the response of ion intensity of mass 38 as a function of added $F_2$ at low concentrations. FIG. 12 indicates the ion intensity of mass 38 as a function of $F_2$ concentration (high concentration). FIG. 13 indicates the ion intensity of mass 70 as a function of $Cl_2$ concentration. FIG. 14 indicates the response of the experimental mass spectrometer system to various amounts of $OF_2$ in $N_2$. Ions of mass 38 and 35 represent $F_2^+$ and $OF^+$, respectively.

Figure 15:
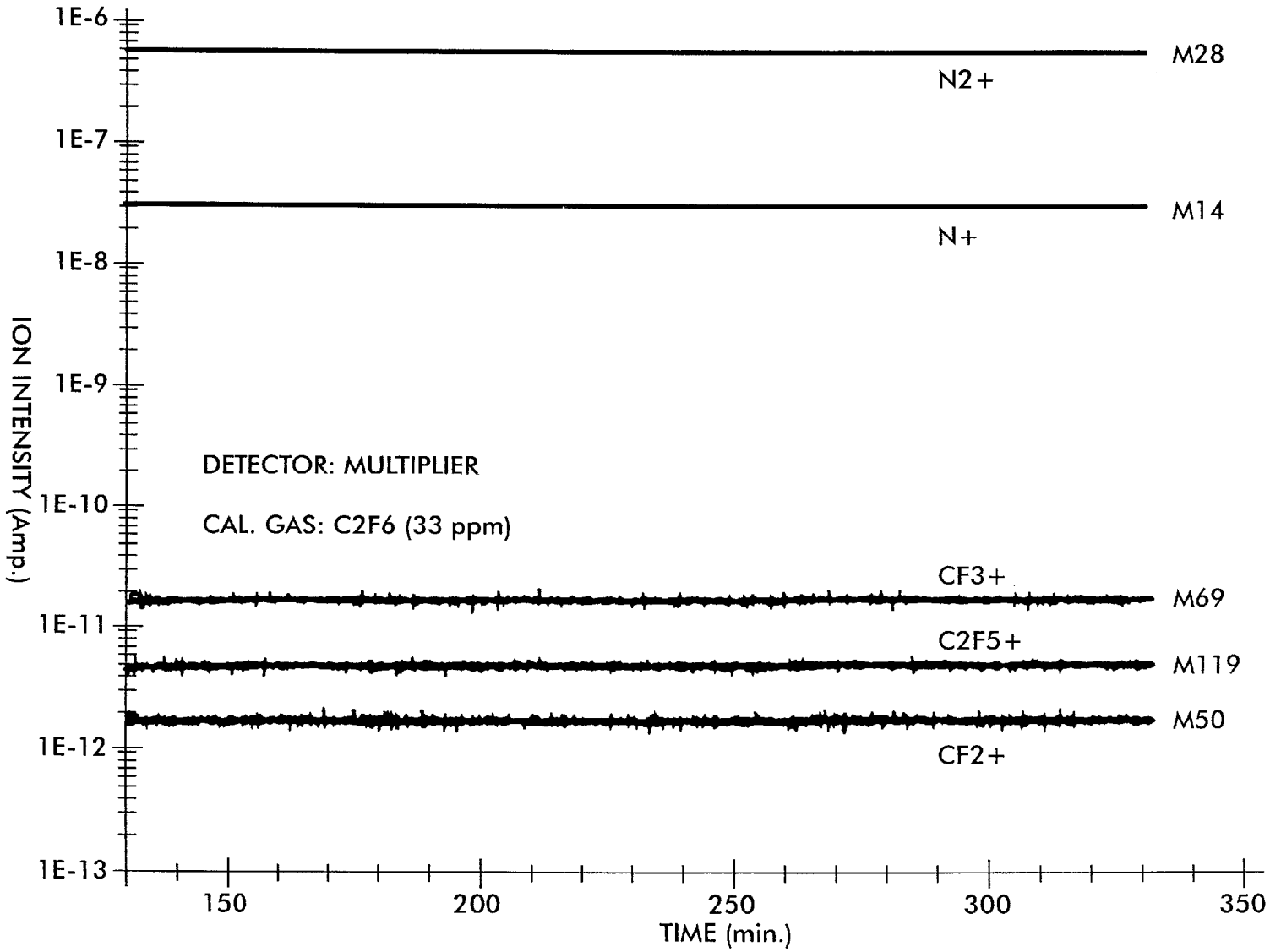
FIG. 15 is graphical illustration of an example of the response of the mass spectrometer system of the present invention for intensities of various ionic species representing $C_2F_6$ and $N_2$.

A mass spectrometer using the inlet 10 of the present invention should be sufficiently stable during measurements. A significant change in ion intensity due to instability in electrical hardware, or changing pressure inside the ion source would compromise the accuracy of measurements. Effluent monitoring generally takes about three hours; the change in ion intensities should be less than three percent standard deviation over this three hour period. For most mass spectrometer systems, this level of stability can be easily achieved when a Faraday cup is used as a detector. It is difficult to obtain the same level of stability when an electron multiplier is used as a detector, because the degradation of the multiplier can be significant when it experiences corrosive gases or high pressures. To alleviate this effect, a very low pressure should preferably be maintained inside the vacuum chamber. FIG. 15 shows a plot of several ions of $C_2F_6$ and $N_2$ as a function of time when a multiplier was used as the detector. The experimental results indicate that the percent standard deviation of the ion intensities is less than 3 percent over three hours. This demonstrates that the sample inlet effectively controls the flow of sample gas into the mass spectrometer and that the mass spectrometer hardware is adequately stable.

Figure 16:
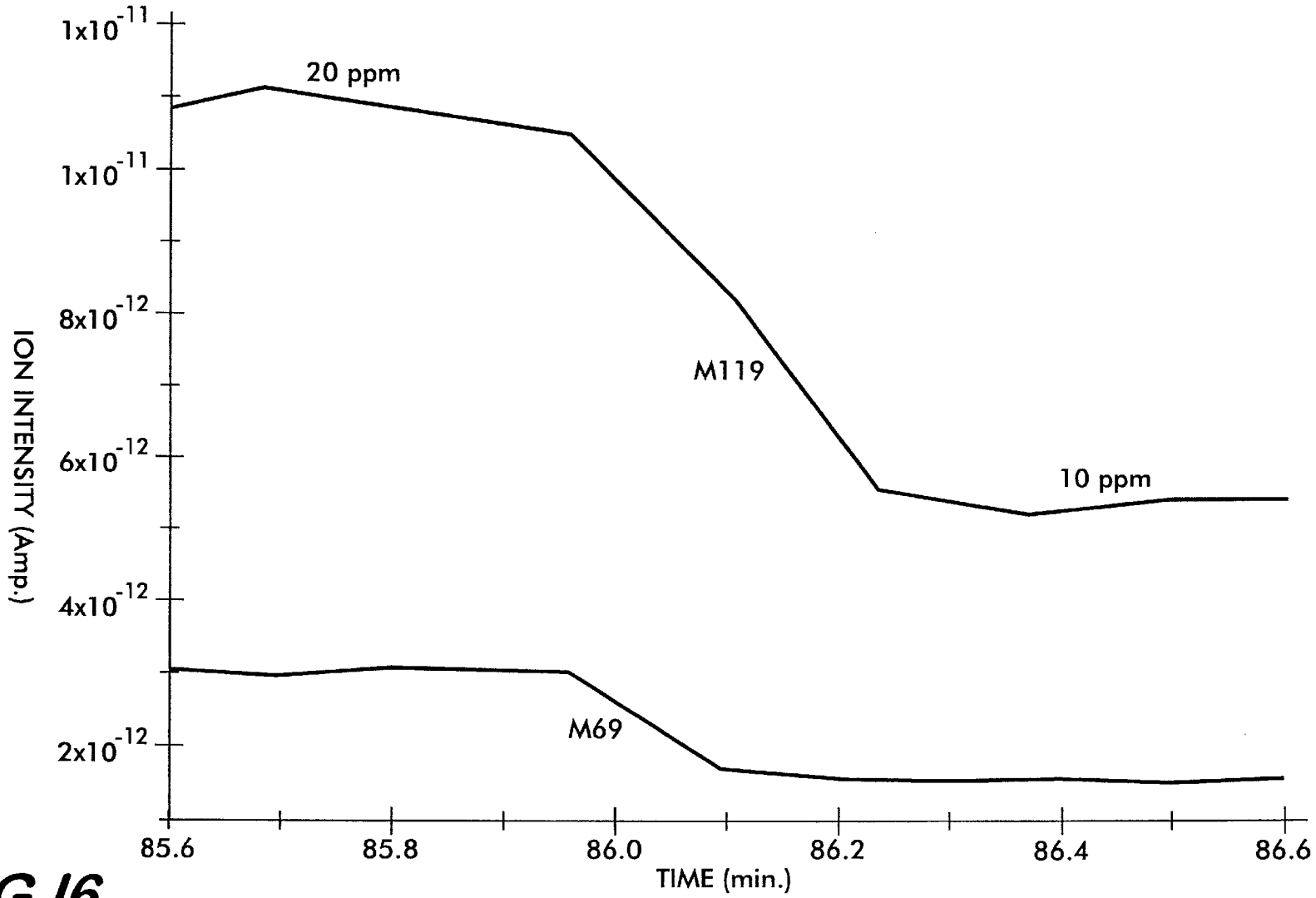
FIG. 16 is a graphical illustration of an example of the response of the mass spectrometer system of the present invention when $C_2F_6$ concentration changes from 20 ppm to 10 ppm.

The response time of the mass spectrometer system depends mainly on the number of monitored ions and dwelling time for each ion. Since $C_2F_6$ does not stick to the walls of the tubes, changes in ion intensities of mass 69 and 119 were used to estimate the response time of the mass spectrometer system. FIG. 16 shows the change in ion intensities when the concentration of $C_2F_6$ was decreased from 20 ppm to 10 ppm. The response of the mass spectrometer system was estimated to be less than 10 seconds when seven ions were monitored with a one-second dwelling time for each ion. It takes about one second for the mass spectrometer to stabilize after each monitoring cycle. This indicates that the sample inlet 10 does not cause any significant delay in the response time. The short response time is important for monitoring effluent gas from etch processes because the duration of some process steps is less than 30 seconds.

Although illustrated and described herein with reference to specific embodiments, the present invention nevertheless is not intended to be limited to the details shown. Rather, various modifications may be made in the details within the scope and range of equivalents of the claims without departing from the spirit of the invention.

We claim:

1. A gas sampling and inlet device for a mass spectrometer comprising a substantially hollow housing sleeve having a first open inside region and a substantially hollow inner sleeve having a second open inside region having a cross-sectional area, said inner sleeve coaxial to said housing sleeve, said housing sleeve having a first end, a hollow body, and a second end, said inner sleeve having a inlet end, a hollow body, and an outlet end, said first end and said inlet end having a first end cap sealingly connected thereto, said, second end having a second end cap sealingly connected thereto, said outlet end being open such that said second open inside region is in fluid communication with said first open inside region, said first end cap having a small diameter first orifice adapted to receive a gaseous fluid, said small diameter first orifice having a substantially smaller area than the cross-sectional area of the second open inside region to avoid capillary action in said second open inside region, and said second end cap sealingly connected to the mass spectrometer, said second end cap having a second orifice adapted to receive a gaseous fluid into the mass spectrometer, said housing sleeve having a vacuum means in fluid communication with said hollow body of said housing sleeve.

2. A gas sampling and inlet device as in claim 1, wherein said second orifice is substantially smaller in diameter than said first orifice.

3. A gas sampling and inlet device as in claim 1, wherein said second orifice has a diameter in the range of about 10% to about 40% of a diameter of said first orifice.

4. A gas sampling and inlet device as in claim 1, wherein said vacuum means is a vacuum source tube sealingly connected to said housing sleeve at a location between said inlet end and said outlet end of said inner sleeve.

5. A gas sampling and inlet device as in claim 1, wherein said housing sleeve is approximately ⅛ inch to ½ inch longer in length than said inner sleeve.

6. A gas sampling and inlet device as in claim 1, wherein said vacuum means includes a vacuum source tube sealingly connected to said housing sleeve at a location on said housing sleeve between said inlet end and said outlet end.

7. A gas sampling and inlet device as in claim 1, wherein the inlet device is operated in a viscous flow regime.

8. A gas sampling and inlet device as in claim 1, wherein the inlet device is made of metal.

9. A gas sampling and inlet device as in claim 1, wherein a pressure maintained inside said housing sleeve is approximately 10 to 100 torr.

10. A gas sampling and inlet device for a mass spectrometer, comprising:

(a) a substantially hollow housing sleeve having a first end, a body, a second end, an inside housing sleeve surface and an outside housing sleeve surface, said inside housing sleeve surface forming a first open inside region having a first cross-sectional area, said second end of said hollow housing sleeve sealingly connected to said mass spectrometer;

(b) a substantially hollow inner sleeve having an inlet end, an outlet end, an inside inner sleeve surface and an outside inner sleeve surface, said outside inner sleeve surface forming a second cross-sectional area that is smaller than said first cross-sectional area such that a hollow pressure reduction region is formed between said housing sleeve and said inner sleeve, said inside inner sleeve surface forming a second open inside region having an inner cross-sectional area;

(c) said first end and said inlet end sealingly and coaxially connected to a first end cap, said first end cap having a small diameter first orifice therethrough adapted to allow a gas to flow directly into said second open inside region, said small diameter first orifice having a substantially smaller cross-sectional area than said inner cross-sectional area to avoid capillary action in said second open inside region;

(d) said second end sealingly connected to a second end cap, said second end cap having a small diameter second orifice therethrough adapted to allow a gas to flow directly into the mass spectrometer;

(e) said outlet end extending to a location adjacent said second end where said hollow housing sleeve is sealingly connected to the mass spectrometer, wherein said first open region is in fluid communication with said second open inside region; and (f) a vacuum source tube sealingly connected to said body of said housing sleeve and having an interior region in fluid communication with said first open inside region.

11. A gas sampling and inlet device as in claim 10, wherein said second orifice is substantially smaller in diameter than said first orifice.

12. A gas sampling and inlet device as in claim 10, wherein said second orifice has a diameter that is in the range of about 10% to about 40% of a diameter of said first orifice.

13. A gas sampling and inlet device as in claim 10, wherein said vacuum source tube is sealingly connected to said housing sleeve at a location between said inlet end and said outlet end.

14. A gas sampling and inlet device as in claim 10, wherein said housing sleeve is approximately ⅛ inch to ½ inch longer in length than said inner sleeve.

15. A gas sampling and inlet device as in claim 10, wherein said vacuum source tube is sealingly connected to said housing sleeve at a location on said housing sleeve between said inlet end and said outlet end of said inner tube.

16. A gas sampling and inlet device as in claim 10, wherein the inlet device is operated in a viscous flow regime.

17. A gas sampling and inlet device as in claim 10, wherein the inlet device is made of metal.

18. A gas sampling and inlet device as in claim 10, wherein a pressure maintained inside said housing sleeve is approximately 10 to 100 torr.

19. A gas sampling and inlet device for a mass spectrometer, comprising:

(a) a substantially hollow, tubular housing sleeve having a cylindrical cross section, a first end, a body, a second end, a first inside surface and a first outside surface, said first inside surface forming a cylindrical first open inside region having a circular cross section having a first diameter, said second end sealingly connected to the mass spectrometer;

(b) a substantially hollow, tubular inner sleeve having an inlet end, an outlet end, a second inside surface and a second outside surface, said second inside surface forming a cylindrical second open inside region having an inner cross-sectional area, said second outside inner sleeve surface forming a circular cross-sectional area having a second diameter that is smaller than said first diameter such that a hollow pressure reduction region having a annular cross-sectional area is formed between said first inside surface and said second outside surface;

(c) said first end and said inlet end sealingly and coaxially connected to a first end cap, said first end cap having a small diameter first orifice therethrough adapted to allow a gas to flow directly into said cylindrical second open inside region, said small diameter first orifice having a substantially smaller cross-sectional area than said inner cross-sectional area to avoid capillary action in said second open inside region;

(d) said second end sealingly connected to a second end cap, said second end cap having a small diameter second orifice therethrough adapted to allow a gas to flow directly into said mass spectrometer;

(e) said outlet end extending to a location adjacent said second end wherein said housing sleeve is sealingly connected to said mass spectrometer, wherein said first open region is in fluid communication with said open second inside region;

(f) a vacuum source tube sealingly connected to said body of said housing sleeve and having an interior region in fluid communication with said open inside region of said housing sleeve.

20. A gas sampling and inlet device as in claim 19, wherein said second orifice is substantially smaller in diameter than said first orifice.

21. A gas sampling and inlet device as in claim 19, wherein said second orifice in the second end cap has a diameter that is in the range of about 10% to about 40% of said first orifice in the first end cap.

22. A gas sampling and inlet device as in claim 19, wherein said vacuum source tube is sealingly connected to said housing sleeve at a location between said inlet end and said outlet end of said inner sleeve.

23. A gas sampling and inlet device as in claim 19, wherein said housing sleeve is approximately ⅛ inch to ¼ inch shorter in length than said inner sleeve.

24. A gas sampling and inlet device as in claim 19, wherein said vacuum source tube is sealingly connected to said housing sleeve at a location on said housing sleeve between said inlet end and said outlet end.

25. A gas sampling and inlet device as in claim 19, wherein the inlet device is operated in a viscous flow regime.

26. A gas sampling and inlet device as in claim 19, wherein the inlet is made of metal.

27. A gas sampling and inlet device as in claim 19, wherein a pressure maintained inside said housing sleeve is approximately 10 to 100 torr.

* * * * *